United States Patent [19]

Aeschbach

[11] 4,048,890

[45] Sept. 20, 1977

[54] PUNCHING TOOL DIE

[75] Inventor: Fritz Aeschbach, Morges, Switzerland

[73] Assignee: Raskin S.A., Switzerland

[21] Appl. No.: 738,723

[22] Filed: Nov. 4, 1976

[30] Foreign Application Priority Data

Nov. 17, 1975 Switzerland ..... 14843/75

[51] Int. Cl.[2] ..... B26F 1/14

[52] U.S. Cl. ..... 83/146; 83/124; 83/685; 83/690

[58] Field of Search ..... 83/111, 112, 124, 145, 83/146, 685, 168, 690

[56] References Cited

U.S. PATENT DOCUMENTS

| | | | |
|---|---|---|---|
| 2,404,793 | 7/1946 | Dickerman | 83/685 |
| 3,358,538 | 12/1967 | Maceyka | 83/690 X |

*Primary Examiner*—Willie G. Abercrombie

*Attorney, Agent, or Firm*—Robert E. Burns; Emmanuel J. Lobato; Bruce L. Adams

[57] ABSTRACT

The die of a punching tool has a body of relatively soft and elastically deformable material with a through hole in extension of a through hole of the die but of smaller section, corresponding to that of a punch which passes through the die with a clearance, so that as the punch is withdrawn waste pieces are retained in the body by elastic deformation.

5 Claims, 1 Drawing Figure

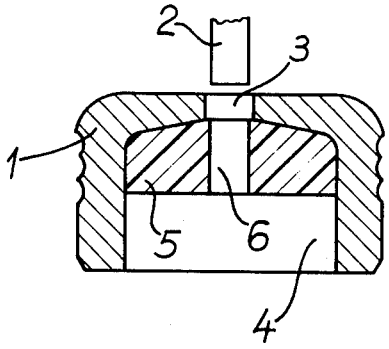
2
3
1
5
6
4

PUNCHING TOOL DIE

The invention relates to punching or stamping tools.

In stamping tools with a punch and die, for example for punching holes in sheet metal, it is necessary to allow for a clearance between the punch and the walls of the die. The removed waste part of the sheet however tends to adhere to the punch, especially when the sheet must be slightly lubricated. These waste pieces may then fall from the withdrawn punch and produce marks in the following sheet being punched, which damages the sheet and may even make it unusable.

Various expedients have been employed to prevent the waste pieces from adhering to and being withdrawn with the punch.

One expedient has been to blow off the waste piece by delivering compressed air through the punch; however, this involves a complicated structure and is not suitable for punches of small section. Attempts have also been made to use a suction effect, but the results have not been entirely satisfactory. Another expedient has been to provide the die hole with a rough, unpolished surface which retains the waste pieces by friction; however, this is not only costly, but in time the surface becomes polished and loses its retaining effect. Finally, tests have been made with a die having a tapering conical hole so that the waste piece is gripped as it is pressed down into the hole; this has given fairly satisfactory results when the clearance between the punch and the die is small, but is insufficient when there is a large clearance.

An object of the invention is to provide a simple and inexpensive arrangement which avoids the drawbacks and limitations of the prior art.

According to the invention, the die of a stamping or punching tool, which has a through hole having a greater cross-sectional area than a punch to receive the punch with a clearance, comprises on a side thereof opposite the side in which the punch is inserted a body of softer and more elastic material than the material of the die, said body having a through hole in extension of that of the die but of a lesser cross-sectional area substantially equal to that of the punch.

When a waste piece of a workpiece is pushed by the punch through the die, it penetrates into the through hole of the extra body which elastically deforms and grips the piece which is thus retained in the body. During successive stamping operations, the successive waste pieces intermittently push the previous pieces through the body until they discharge from it into a chute or a recuperation container.

An embodiment of the invention is shown, by way of example, in the single FIGURE of the accompanying drawing which is an axial cross-section of a die with its punch shown in elevation.

The illustrated die 1 is part of a multiple matrix of a turrethead press and cooperates with a punch 1 whose end is schematically shown and has a smaller cross-section than through-hole 3 of the die 1. The die 1 has an upper surface for supporting a workpiece (not shown) in the form of a sheet, and a hollow underneath part 4 in which is lodged a body 5 formed from a solid mass of synthetic material, for example that available under the Trade Mark Araldite. Body 5 has an axial through hole

6 in extension of the hole 3 of die 1 but of smaller cross-section substantially equal to the cross-section of punch 2.

The hole 6 is obtained by inserting the punch 2 fully in the hole 3 of die 1 while the die is inverted, pouring liquid Araldite (Trade Mark) into the hollow part 4 so that it surrounds the punch 2, and withdrawing the punch 2 when the mass has solidified sufficiently.

The body 5 could alternatively be of other synthetic materials such as Nylon, Teflon (Trade Mark), PVC or synthetic rubber. It is also possible to use a hardened rubber, a metal or a metal-based material, such as that available under the Trade Mark DEVCON which is in pasty form and hardens when exposed to air. It is also possible to use a mixture of the mentioned products.

Whichever material is used it should have a certain elasticity (i.e. more readily elastically deformable than the material of the die) while being resistant to wear by the metal waste parts so that it will not wear out too rapidly.

As shown, the through hole 6 has an axial length substantially greater than its diameter so that in use it is able to retain the waste pieces removed from several successively punched sheets while allowing these pieces to be intermittently driven through said successively discharged from the hole 6.

What is claimed is:

1. In a stamping or punching tool comprising a die and a punch, in which the die has a through hole for receiving the punch, said hole having a greater cross-sectional area than the punch to receive the punch with a clearance, the improvement wherein the die comprises on a side thereof opposite the side in which the punch is inserted a body of softer and more elastic material than the material of the die, said body having a through hole in extension of said through hole of die but of a lesser cross-sectional area substantially equal to that of the punch.

2. A tool according to claim 1, in which said body is at least partially of a synthetic material.

3. A tool according to claim 1, in which said body is of hardened rubber.

4. A tool according to claim 1, in which said body is at least partially metallic.

5. In a puunching tool die having a workpiece-support surface with means defining a through-hole for the passage of a piece removed from a workpiece on said surface by a withdrawable punching tool punched through said workpiece into said through-hole, the improvement comprising on a side of said die opposite said surface, a body of material which is softer and more elastically deformable than the material of said die, said body having means defining a through-hole in extension of that of said die, but of lesser cross-sectional area, for elastically deforming and gripping said pieces removed from workpieces to retain said pieces in said body when said punch is withdrawn, said through-hole of said body having a length whereby it is able to retain the pieces removed from several successively punched workpieces while allowing said pieces to be intermittently driven therethrough said successively discharged from said body.

* * * * *